US005742888A

United States Patent [19]

Fuchiwaki et al.

[11] Patent Number: 5,742,888

[45] Date of Patent: Apr. 21, 1998

[54] TRANSFER APPARATUS FOR AN IMAGE FORMING APPARATUS

[75] Inventors: Takashi Fuchiwaki; Kouji Hamabe; Osamu Handa, all of Ebina, Japan

[73] Assignee: Fuji Xerox Co., Ltd., Tokyo, Japan

[21] Appl. No.: 722,564

[22] Filed: Sep. 27, 1996

[30] Foreign Application Priority Data

Sep. 27, 1995 [JP] Japan ..... 7-273517

[51] Int. Cl.[6] ..... G03G 15/16

[52] U.S. Cl. ..... 399/308

[58] Field of Search ..... 399/66, 121, 302, 399/308, 313, 318

[56] References Cited

U.S. PATENT DOCUMENTS

| | | | |
|---|---|---|---|
| 4,435,067 | 3/1984 | Draai et al. | 399/308 |
| 4,531,825 | 7/1985 | Miwa et al. | 399/318 X |
| 4,542,978 | 9/1985 | Tarumi et al. | 399/308 |
| 5,243,392 | 9/1993 | Berkes et al. | 399/308 |
| 5,483,330 | 1/1996 | Ogiyama et al. | 399/318 |

FOREIGN PATENT DOCUMENTS

| | | |
|---|---|---|
| 62-206567 | 9/1987 | Japan . |
| 4-97186 | 3/1992 | Japan . |
| 4-188176 | 7/1992 | Japan . |

*Primary Examiner*—S. Lee
*Attorney, Agent, or Firm*—Oliff & Berridge, P.L.C.

[57] ABSTRACT

A transfer apparatus is provided which is capable of effectively preventing a defect in transference caused from a gap between a transfer member and an intermediate transfer belt to form an excellent image free from an image defect such as whitening. The transfer apparatus for an image forming apparatus for primarily transferring a toner image formed on an image holding member to an intermediate transfer belt and then secondarily transferring the image, which has been primarily transferred onto the intermediate transfer belt, to a transfer member, includes a transfer unit for secondarily transferring the image having a transfer roll separably disposed on the surface of the intermediate transfer belt, which holds the toner image, and an opposite roll disposed to be in contact with the inner surface of the intermediate transfer belt at a position at which the opposite roll is opposite to the transfer roll. When the transfer roll has been brought into contact with the intermediate transfer belt, the central position of the transfer roll is disposed upstream with respect to the central position of the opposite roll in a direction in which the intermediate transfer belt is moved, and an angle made between a line connecting the center of the transfer roll and the center of the opposite roll to each other and the intermediate transfer belt is set to be smaller than 90°, and the intermediate transfer belt is deformed to have a shape along the transfer roll and the opposite roll.

3 Claims, 7 Drawing Sheets

TRANSFER APPARATUS FOR AN IMAGE FORMING APPARATUS

BACKGROUND OF THE INVENTION

1. Field of the Invention

The invention relates to an image forming apparatus, such as a copying machine and a printer, using electrophotographic technique, and more particularly, to an improvement in a transfer apparatus for a type of an image forming apparatus using an intermediate transfer belt.

2. Description of Related Art

A conventional color image forming apparatus has been adapted to a method of transferring, onto transfer paper, a toner image formed on a latent image holding member thereof in which a transfer drum which is rotated at substantially the same circumferential speed as that of the latent image holding member is disposed adjacent to the latent image holding member, and an operation for temporarily winding the transfer paper around the transfer drum to hold the transfer paper and electrostatically transferring the toner image onto the transfer paper is repeated plural times. Thus, toner images in a plurality of color tones are directly multi-transferred onto the transfer paper wound around the transfer drum.

However, a method of the foregoing type encounters a difficulty in holding thick and firm transfer paper on the transfer drum and thus there arises a problem in that only limited types of transfer paper can be used. As a result, the foregoing method suffers from problems in that a defect takes place in multi-transferring the images and that color registration is undesirably shifted.

Accordingly, a color image forming apparatus of a type having a means except the transfer drum has been suggested in the Unexamined Japanese Patent Application Publication No. 62-206567, which comprises an intermediate transfer belt. The apparatus, as shown in FIG. 8, has a structure such that toner image T formed on a photosensitive drum 101 is primarily transferred onto an intermediate transfer belt 102. Then, the primarily-transferred image on the intermediate transfer belt 102 is secondarily transferred onto transfer paper 103. Referring to FIG. 8, a transfer unit 104 for the secondary transference has a bias roll 105 disposed separably on the surface of the intermediate transfer belt 102 on which the image is held, and an opposite roll 106 disposed to be contact with the inner surface of the intermediate transfer belt 102 at a position at which the opposite roll 106 is opposite to the bias roll 105.

In the case where an intermediate transfer belt of the above-mentioned type is used, an image forming process is structured such that photoelectron images decomposed for each of different color components are exposed onto the photosensitive drum 101 so that electrostatic latent images for the respective color components are formed. Then, electrostatic latent images formed into visual images by corresponding color toners are temporarily stacked and primarily transferred on the intermediate transfer belt member so that a synthesized image is obtained. Then, the synthesized image is collectively and secondarily transferred onto one transfer paper 103.

Therefore, use of an apparatus of a type having an intermediate transfer belt of the foregoing type enables a color image to be obtained on a variety of paper sheets including thick paper which has been considered impossible with an apparatus of a type using the transfer drum so that a defect occurring in transferring multiplicity of images and generation of shift of color registration are prevented. Moreover, a necessity of continuously rotating the transfer drum around which the sheet is wound and held can be eliminated. Therefore, the paper feeding mechanism can be simplified so that generation of paper jam is prevented.

However, the apparatus of the foregoing type is, as shown in FIG. 8, structured such that, when the bias roll 105 is brought into contact with the surface of the intermediate transfer belt 102 on which the toner image is held, the angle $\alpha$ made between a line connecting the center of the bias roll 105 and that of the opposite roll 106 and the intermediate transfer belt 102 is made to be substantially 90°. Therefore, as shown in FIG. 9, when the transfer paper 103 is allowed to pass through the transfer unit 104, a gap is unintentionally formed between the intermediate transfer belt 102 and the transfer paper 103 right in front of the transfer nip. Thus, there arises a technical problem in that a formed image is adversely affected.

Specifically, the gap is, as shown in FIG. 9, formed between the transfer paper 103 and the intermediate transfer belt 102 right in front of the transfer nip. If the gap and a transfer electric field 110 are enlarged to a certain value in accordance with the Paschen's law (if the values reach a discharge region shown in FIG. 10), Paschen discharge takes place. If + ions 111 and − ions 112 are generated attributable to the Paschen discharge, + ions are allowed to adhere to toner particles 113 which are negatively charged, causing the polarity of the toner particles to be changed to be positive (to the reversed polarity as represented by reference numeral 114).

As a result, toner particles intended to be transferred to the transfer paper 103 and allowed to adhere to the intermediate transfer belt 102 are unintentionally maintained on the intermediate transfer belt 102. As an alternative to this, although the toner particles are temporarily transferred as desired, they again are allowed to adhere to the intermediate transfer belt 102. Thus, a so-called defect in transference takes place. As a result, only negative-polarity toner particles, which have not been shifted to the positive polarity, are transferred to the transfer paper 103. Therefore, the obtained copy encounters an image defect, called "whitening".

As another method adaptable to the structure using the intermediate transfer belt, a method disclosed in, for example, Unexamined Japanese Patent Application Publication No. 4-97186 has been known. According to the disclosure above, two transfer rolls each having a small diameter are disposed to be, through the intermediate transfer belt, opposite to a roll among a plurality of rolls disposed on the inner surface of the intermediate transfer belt that is disposed at a position at which the secondary transference is performed. Moreover, the intermediate transfer belt and the transfer paper are arranged to be brought into contact with each other on a line connecting the roll on the inner surface of the intermediate transfer belt at the position at which the secondary transference is performed and the centers of the pair of transfer rolls each having the small diameter.

However, the foregoing type has the structure such that two transfer rolls disposed at a predetermined distance and each having a small diameter are, through the intermediate transfer belt, in contact with the roll disposed on the inner surface of the intermediate transfer belt. Since the intermediate transfer belt usually has a semi-electrically-conductive characteristic, the transfer paper cannot easily come in contact with the intermediate transfer belt. Thus, the transfer paper is separated from the intermediate transfer belt at a position between the two transfer rolls. As a result, jams of transfer paper take place frequently. In particular, the above-mentioned tendency becomes a critical problem with OHP sheets. What is worse, since two transfer rolls are provided, an image transferred by the first transfer roll is unintentionally returned to the-intermediate transfer belt at the position of the second transfer roll. As a result, the density of the obtained image is unsatisfactorily low. In particular, the foregoing tendency critical in a fine line portion of the image has been required to be solved.

As another method of a type using the intermediate transfer belt, a method disclosed in, for example, Unexamined Japanese Patent Application Publication No. 4-188176 has been known. According to the disclosure above, the transfer roll is allowed to be, through the intermediate transfer belt, opposite to a roll disposed on the inner surface of the intermediate transfer belt at a position at which the secondary transference is performed. Moreover, the line connecting the center of the roll disposed at which the secondary transference is performed and the center of the transfer roll and the direction, in which the transfer paper is moved, make an angle which is not the right angle. As a result, the transfer paper is enabled to be in plane contact with the outer surface of the intermediate transfer belt when the transfer paper is moved. Thus, the contact between the intermediate transfer belt and the transfer paper can reliably be maintained. Therefore, lack of image transference can be prevented.

However, in the foregoing type, the position of the moving surface of the belt is the same as that in the case where the line connecting the center of the roll disposed at the position at which secondary transference is performed and the center of the transfer roll is arranged to be the right angle from the direction in which the transfer paper is moved. That is, since the electrostatic adhesive force between the transfer paper and the intermediate transfer belt is very small in the case of a semi-electrically-conductive material, such as the intermediate transfer belt, setting of the angle between transfer roll and the direction in which the transfer paper is moved to make an angle except the right angle and use of a transfer roll made of a soft material cause the intermediate transfer belt and the transfer paper to be brought into close contact with each other in only the transfer region in which the rolls are in contact with each other through the belt. Therefore, a gap is formed between the transfer paper and the intermediate transfer belt right in front of the transfer nip. Therefore, an image defect, called "whitening " takes place because of a similar reason.

SUMMARY OF THE INVENTION

In view of the foregoing, an object of the invention is to provide a transfer apparatus for an image forming apparatus of a type using an intermediate transfer belt, which is capable of solving the foregoing problem experienced with the conventional apparatus and caused by a gap between the transfer member and the intermediate transfer belt so as to form an excellent image free from image defects such as whitening.

Thus, the transfer apparatus in the invention is provided which is capable of effectively preventing a defect in transference caused from a gap between a transfer member and an intermediate transfer belt to form an excellent image free from an image defect such as whitening. The transfer apparatus for an image forming apparatus for primarily transferring a toner image formed on an image holding member to an intermediate transfer belt and then secondarily transferring the image, which has been primarily transferred onto the intermediate transfer belt, to a transfer member, includes a transfer unit for secondarily transferring the image having a transfer roll separably disposed on the surface of the intermediate transfer belt, which holds the toner image, and an opposite roll disposed to be in contact with the inner surface of the intermediate transfer belt at a position at which the opposite roll is opposite to the transfer roll. When the transfer roll has been brought into contact with the intermediate transfer belt, the central position of the transfer roll is disposed upstream with respect to the central position of the opposite roll in a direction in which the intermediate transfer belt is moved, and an angle made between a line connecting the center of the transfer roll and the center of the opposite roll to each other and the intermediate transfer belt is set to be smaller than 90°, and the intermediate transfer belt is deformed to have a shape along the transfer roll and the opposite roll.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
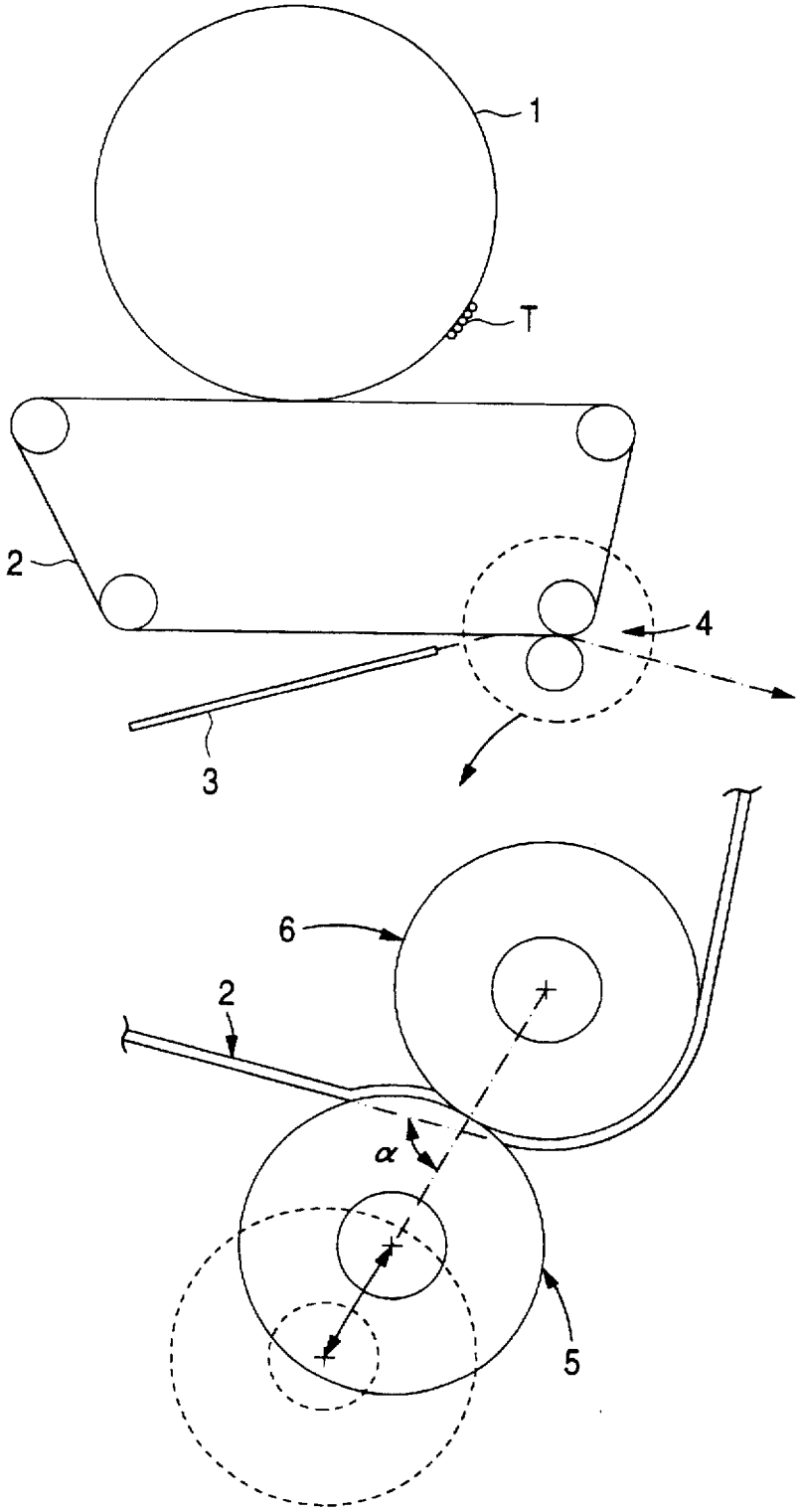
FIG. 1 is an explanatory view of the structure of the image forming apparatus according to the invention.

A transfer apparatus according to the invention, as shown in FIG. 1, is adaptable to an image forming apparatus for primarily transferring a toner image T formed on an image holding member 1 to an intermediate transfer belt 2 and then secondarily transferring the toner image, which has been primarily transferred onto the intermediate transfer belt 2, to a transfer member 3. The transfer apparatus comprises transfer unit 4 for secondarily transferring the toner image including a transfer roll 5 separably disposed on the surface of the intermediate transfer belt 2 which holds the toner image and an opposite roll 6 disposed to be in contact with the inner surface of the intermediate transfer belt 2 at a position at which the opposite roll 6 is opposite to the transfer roll 5, wherein, when the transfer roll 5 has been brought into contact with the intermediate transfer belt 2, the central position of the transfer roll 5 is disposed upstream with respect to the central position of the opposite roll 6 in a direction in which the intermediate transfer belt 2 is moved, and an angle a made between a line connecting the center of the transfer roll 5 and the center of the opposite roll 6 to each other and the intermediate transfer belt 2 is set to be smaller than 90°.

As a result of the above-mentioned technical means, the intermediate transfer belt 2 is a belt capable of temporarily holding the toner image T and comprises an endless belt made of an appropriate elastic material. 10 When an electrostatic transfer method is employed, the belt must have appropriate electroconductivity. In this case, as the material for the intermediate transfer belt 2, a material is known which is obtained by adding carbon black in an appropriate quantity to resin or rubber such as polyimide, polycarbonate, polyester, polypropylene, polyethylene terephthalate.

In order to realize more complete secondary transference, it is preferable that the intermediate transfer belt 2 be deformed to fit the outer shape of the transfer roll 5 and that of the opposite roll 6 when the transfer roll 5 has been brought into contact with the intermediate transfer belt 2. In order to cause the intermediate transfer belt 2 to satisfactorily follow the outer shape of each of the rolls 5 and 6, it is preferable that the surface hardness of the transfer roll 5 is made to be smaller than that of the opposite roll 6 so as to cause the surface of the transfer roll 5 to be elastically deformed when the transfer roll 5 has been brought into contact with the intermediate transfer belt 2.

The transfer unit 4 is simply required that the transfer roll 5 having the appropriate hardness and the opposite roll 6 are able to hold the intermediate transfer belt 2 and the transfer member 3 in order to realize a satisfactory transference performed between the transfer roll 5 and the opposite roll 6 when the toner image T primarily transferred from the image holding member 1 and held on the intermediate transfer belt 2 is secondarily transferred onto the transfer member 3. Therefore, any modification may be permitted within the above-mentioned scope. In a viewpoint of easily transferring the non-transferred toner image, it is preferable that an electrostatic transfer method be employed with which a satisfactory transference electric field can be obtained by applying a predetermined voltage level between the transfer roll 5 and the opposite roll 6 and by grounding the elements.

The angle α between the line connecting the center of the transfer roll 5 and the center of the opposite roll and the intermediate transfer belt 2 is required to be smaller than 90°. In a viewpoint for preventing disorder of the image by preventing load change taking place with the intermediate transfer belt 2, it is preferable that the angle be larger than 60°.

In a viewpoint for efficiently moving the intermediate transfer belt and rotating the opposite roll 6, the direction in which the transfer roll 5 is brought into contact with the intermediate transfer belt 2 and apart from the same is the same as the direction of the line connecting the center of the transfer roll 5 and the center of the opposite roll 6.

The operation of the invention of the apparatus shown in FIG. 1 will now be described.

When the primary transference is performed, the transfer roll 5 apart from the intermediate transfer belt 2 is brought into contact with the intermediate transfer belt 2 to make a preparation for the secondary transference. Since the angle α between the line connecting the center of the transfer roll 5 and the center of the opposite roll and the intermediate transfer belt 2 is smaller than 90° at this time, the intermediate transfer belt 2 is deformed into a S-shape along both of the transfer roll 5 and the opposite roll 6.

After the non-fixed toner image T has been primarily transferred onto the intermediate transfer belt 2 and thus it has been held on the intermediate transfer belt 2, the rotation of the intermediate transfer belt 2 results in the non-fixed toner image T being moved to a position near the transfer unit 4 which is the position facing the conveyance passage for the transfer member 3 and at which the secondary transference is performed. On the other hand, the transfer member 3 moved to the transfer unit 4 in synchronization with the timing of the above-mentioned movement is held between the transfer roll 5 and the intermediate transfer belt 2.

When voltage, the polarity of which is reversed to the polarity of the charge of the toner is applied to the transfer roll 5 at this time, a transference electric field is formed between the transfer roll 5 and the opposite roll 6 serving as an opposite electrode for the transfer roll 5 and grounded. Then, the transfer member 3 is allowed to pass through the transfer unit 4 along the intermediate transfer belt 2 deformed into the S-shape attributable to the rotation of the transfer roll 5 and the movement of the intermediate transfer belt 2.

As a result, while the transfer member 3 being reliably brought into contact with the intermediate transfer belt 2 in the transference region and right in front of the transference region, the no-fixed toner image T on the intermediate transfer belt 2 is electrostatically attracted to the transfer member 3. Therefore, secondary transference can reliably be performed.

The transfer apparatus according to the invention applied to a color electrophotographic copying machine will now be described with reference to the FIGS. 2–7.

Figure 2:
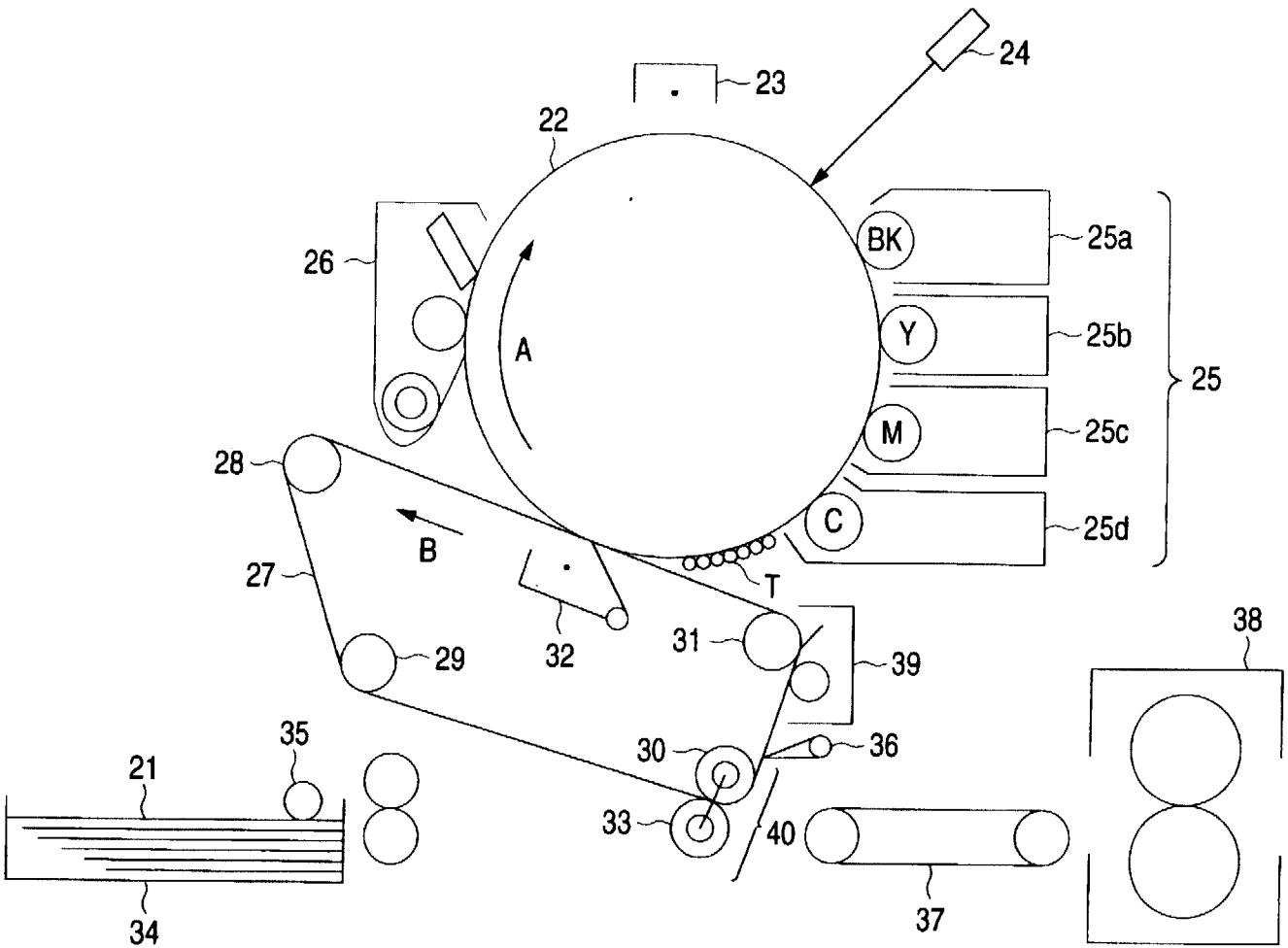
FIG. 2 is a schematic side view of a color electrophotographic copying machine according to the invention.

FIG. 2 is a schematic side view of a color electrophotographic copying machine according to the invention.

Referring to FIG. 2, reference numeral 21 represents transfer paper, 22 represents a photosensitive drum, 23 represents a primary charger for previously charging the photosensitive drum 22, and reference numeral 24 represents a laser exposing unit for writing an electrostatic latent image onto the charged 10 photosensitive drum 22. Reference numeral 25 represents a developing unit including a black developing unit 25*a*, a yellow developing unit 25*b*, a magenta developing unit 25*c* and a cyan developing unit 25*d* which are separably provided, and 26 represents a drum cleaner for removing residual toner on the photosensitive drum 22.

Reference numeral 27 represents an intermediate transfer belt in the form of an endless belt disposed to be in contact or adjacent to the surface of the photosensitive drum 22 and arranged among a plurality of rolls (a drive roll 28 and follower rolls 29, 30 and 31). Reference numeral 32 represents a corona discharging unit disposed on the inside of the intermediate transfer belt 27 at a position at which the intermediate transfer belt 27 approximates maximum (a first transference position) the photosensitive drum 22 so as to serve as a primary transfer unit. Reference numeral 40 represents a secondary transfer unit. The secondary transfer unit 40 is composed of a bias roll 33 disposed to be in contact with the surface of the intermediate transfer belt on which the toner image is held and a backup roll 30 also serving as a follower roll.

Moreover, reference numeral 34 represents a paper feeding tray, 35 represents a feed roller for feeding the transfer paper 21 to the secondary transfer position, and 36 represents a separation claw for separating the transfer paper 21 subjected to the secondary transference from the surface of the intermediate transfer belt 27. Reference numeral 37 represents a conveyance belt, 38 represents a fixing unit, 39 represents a belt cleaner for removing residual toner on the intermediate transfer belt 27 after the secondary transference has been performed.

The bias roll 33, the separation claw 36 and the belt cleaner 39 are disposed separably from the intermediate transfer belt 27. In a case where a color image is formed, the state where the foregoing elements are separated from the intermediate transfer belt 27 is maintained until the non-fixed toner image T of the final color is primarily transferred to the intermediate transfer belt 27.

In this embodiment, the intermediate transfer belt 27 was manufactured such that carbon black was contained in rubber in an appropriate quantity to have a volume resistivity of $10^6$ to $10^{14}$ Ω.cm and a thickness of 0.1 mm.

An image forming process in the thus-structured color image forming apparatus will now be described in detail.

Initially, the surface of the photosensitive drum 22 is uniformly charged by the primary charger 23. Then, the laser exposing unit is operated so that an electrostatic latent image corresponding to, for example, yellow image information is formed on the photosensitive drum 22 which is continuously rotated in a direction indicated by an arrow A shown in the drawing.

On the other hand, the intermediate transfer belt 27 in the form of the endless belt arranged among the drive roll 28, the follower roll 29, the backup roll (the follower roll) 30 and the follower roll 31 is, at substantially the same speed as the circumferential speed of the photosensitive drum 22, being rotated in a direction indicated by an arrow B shown in the drawing. The non-fixed toner image T formed on the photosensitive drum 22 is moved to a position near the primary transference position at which the intermediate transfer belt 27 and the photosensitive drum 22 are in contact with each other or positioned adjacent attributable to the rotation of the photosensitive drum 22. Then, voltage, the polarity of which is reversed to the polarity of the charge of the toner, is applied to the corona discharger 32 disposed on the inner surface of the intermediate transfer belt 27 so that non-fixed toner image T on the photosensitive drum 22 is electrostatically attracted onto the intermediate transfer belt. Thus, the primary transference is performed.

When a monotone image is then formed, the non-fixed toner image T primarily transferred onto the intermediate transfer belt 27 is immediately secondarily transferred onto the transfer paper 21. In a case where a color image is formed by stacking toner images T in a plurality of colors, the process for forming the toner image T on the transfer paper 21 and the primary transference of the toner image T are repeated by the number corresponding to the number of colors. In an example case where a full color image is formed by stacking four color toner images T, the intermediate transfer belt 27 is rotated with the same cycle as that of the photosensitive drum 22 while holding the non-fixed yellow toner image T. Then, whenever the rotation is performed, black, magenta and cyan non-fixed toner images T are sequentially stacked on the non-fixed yellow toner image T on the intermediate transfer belt 27.

Thus, the non-fixed toner image T primarily transferred onto the intermediate transfer belt 27 is, attributable to the rotation of the intermediate transfer belt 27, moved to the secondary transference position facing the conveyance passage for the transfer paper 21. At the secondary transference position, the semiconductive bias roll 33 separated from the intermediate transfer belt 27 when the primary transference has been performed is brought into contact with the intermediate 5 transfer belt 27 for preparing the secondary transference. In synchronization with the movement of the toner image T subjected to the primary transference to the secondary transference position, the transfer paper 21 is fed from the paper feeding tray 34 by the feed roll 35.

As a result, the transfer paper 21 is held between the bias roll 33 and the intermediate transfer belt 27. At this time, the non-fixed toner image T held on the intermediate transfer belt 27 is electrostatically transferred onto the transfer paper 21 by the secondary transfer unit 40.

The transfer paper 21 on which the non-fixed toner image T has been transferred is separated from the intermediate transfer belt 27 by the separation claw 36, and then introduced into the fixing unit 38 by the conveyance belt 37 so that the non-fixed toner image T is subjected to the fixing process. On the other hand, residual toner and paper dust on the intermediate transfer belt 27 from which the non-fixed toner image T has been secondarily transferred are removed by the belt cleaner 39 which is brought into contact with the intermediate transfer belt 27 only if necessary.

Figure 3:
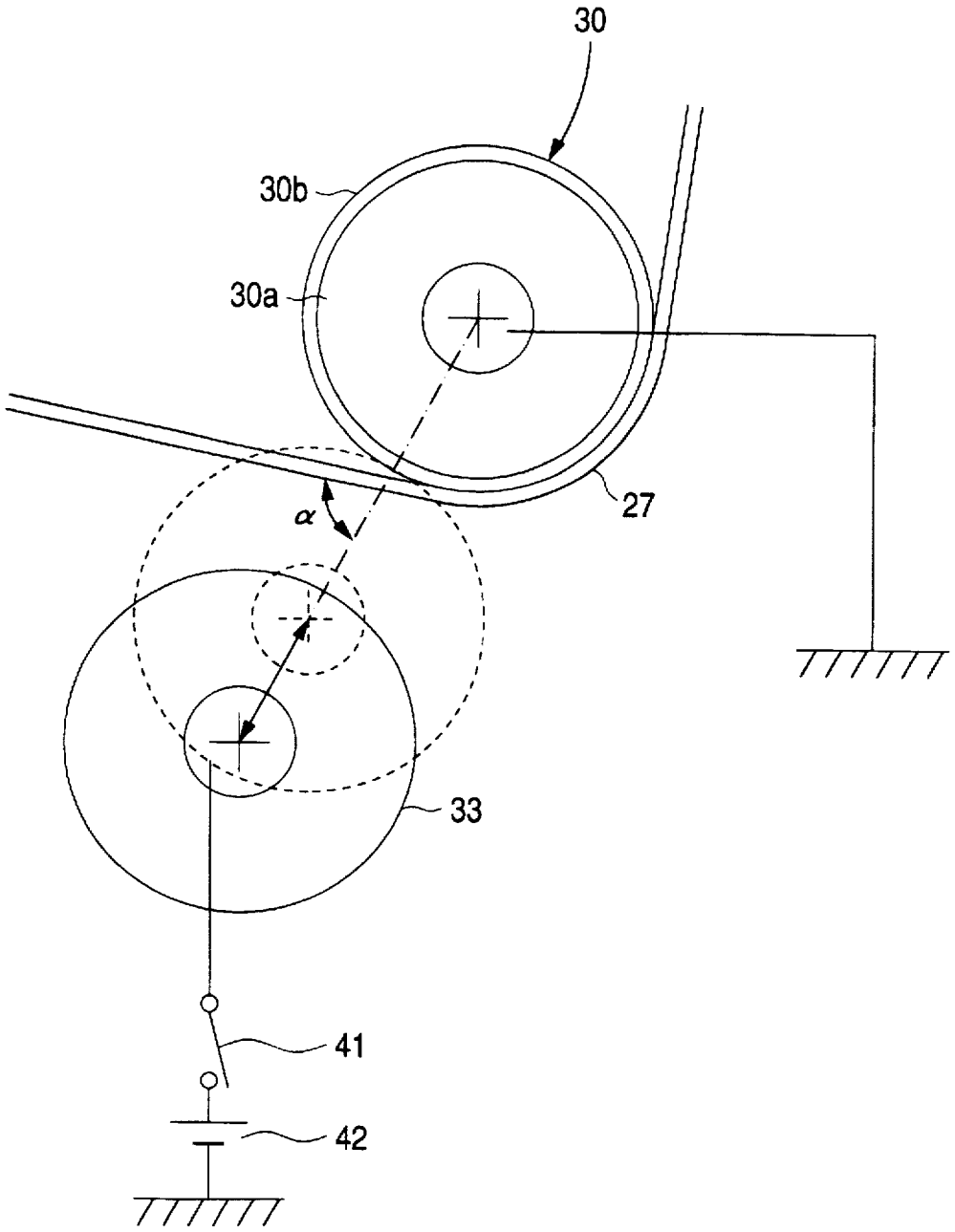
FIG. 3 shows a secondary transfer section according to the invention.

Referring to FIGS. 2 and 3, the secondary transfer unit 40 will now be described in detail.

Referring to FIGS. 2 and 3, the secondary transfer unit 40, as described above, comprises the bias roll 33 separably disposed with respect to the surface of the intermediate transfer belt 27 on which the toner image is held, and the backup roll 30 disposed on the inner surface of the intermediate transfer belt 27 at a position facing the bias roll 33.

In this embodiment, the-backup roll 30 has a grounded conductive roll **30*a*, the surface of which is covered with a semi-conductive thin-layer film 30*b*. In general, the conductive roll 30*a*** comprises a rubber roll or a metal roll in which conductive carbon is dispersed. In this embodiment, a roll manufactured by winding a foamed rubber roll around a metal roll is employed. The hardness of the employed roll is 62 degrees in ASKA C.

On the other hand, the thin-layer film **30*b* may be made by any material obtained by, in an appropriate quantity, dispersing carbon black or the like in PVDF, polyester film, PFA or acrylic material to control the resistance to have a volume resistivity of $10^3$ Ω.cm or greater. In consideration of a fact that the conductive roll 30*a* is able to approach the bias roll 33 as the thickness of the thin-layer film 30*b* is reduced to obtain a satisfactory transfer electric field is obtained even if the voltage applied to the bias roll 33 is low but generation of a pin hole and instability at the time of manufacture become critical and a fact that an effect similar to that obtainable from thinning can be obtained as the dielectric constant of the thin-layer film 30*b* is raised, the thin-layer film 30*b*** made of PVDF having a thickness of *100* μm to 100 μm and a dielectric constant of 8 was employed.

The reason why the material for the thin-layer film **30*b*** has a volume resistivity of $10^3$ Ω.cm or greater will now be described.

That is, an apparatus of the foregoing type has a current capacity of the power source is limited to several mA or lower to secure safety if the human body touches the apparatus, and prevent an accident, such as a fire attributable to a paper jam, damage and combustion of the intermediate transfer belt owning to concentration of electric currents to a damage or a hole formed in the intermediate transfer belt. If an excess current flows attributable to, for example, direct contact of the bias roll 33 with the intermediate transfer belt 27, the structure such that the power supply voltage is lowered attributable to the operation of a current limiter of the power source arranged to prevent continuous supply of the excess currents results in a defect in the transference and damage of the intermediate transfer belt or the like due to the drop of the power supply voltage.

Since the rapid drop of the power supply voltage caused from the operation of the current limiter can be prevented by limiting the magnitude of the excess current to be 100 μA or smaller per unit length in a case where the transfer paper 21 does not exist and since the transfer voltage in this embodiment is about 1000 V, the volume resistance from the position of contact between the backup roll 30 and the intermediate transfer belt 27 to the position at which the conductive roll is grounded must be $10^7$ Ω.cm greater per unit length (1 cm). Therefore, this embodiment is structured such that the volume resistivity is set to be $10^3$ Ω.cm or greater in consideration of safety.

Therefore, use of a backup roll of the foregoing type prevents generation of excess current because the backup roll 30 is coated with the thin-layer film **30*b* having the volume resistivity of $10^3$ Ω.cm greater even if the bias roll 33 and the backup roll 30 are brought into contact with each other through the intermediate transfer belt 27 in a region except the portion corresponding to the transfer paper 21 in a case where the size of the transfer paper 21 is small. As a result, the intermediate transfer belt 27** can be protected from being damaged by the excess current.

The bias roll 33 may have a structure similar to that of the conductive roll **30*a*. In this embodiment, a roll manufactured by winding a foamed rubber roll around a metal roll is employed. The hardness is 33 degrees of ASKA C which is softer than that of the backup roll 30**.

A bias DC power source 42 is connected to the bias roll 33 through a switch 41. By switching on/off the switch 41, bias voltage is selectively applied to the bias roll 33.

In this embodiment, when the bias roll 33 has been brought into contact with the intermediate transfer belt 27, the position of the center of the bias roll 33 is disposed more upstream than the center of the backup roll 30 in the direction of rotation (a direction indicated by an arrow B shown in FIG. 2) of the intermediate transfer belt 27 so that the angle a between the line connecting the center of the bias roll 33 and that of the backup roll 30 and the intermediate transfer belt 27 is made to be smaller than 90°.

The secondary transfer process is performed by the secondary transfer unit 40 as follows:

Initially, the bias roll 33 is moved in a direction indicated by an arrow shown in the drawing for preparing for performing the secondary transfer after the primary transference of the final color has been completed so that the bias roll 33 is brought into contact with the backup roll 30 through the intermediate transfer belt 27. On the other hand, the transfer paper 21 is fed from the paper feeding tray 34 by the feed roll 35 in synchronization with the timing at which the toner image T, which has been primarily transferred, is moved to the secondary transference position.

Then, the switch 41 is switched off at timing immediately before the transfer paper 21 is held between the bias roll 33 and the backup roll 30 so that the bias voltage is applied to the bias roll 33. As a result, the transfer electric field is effected when the transfer paper 21 passes through the secondary transfer unit 40 so that the toner image T on the intermediate transfer belt 27 is electrostatically attracted to the transfer paper 21 and thus the secondary transference is performed.

Then, with reference to FIGS. 4 and 5, the operation to be performed at a moment at which the transfer region between the backup roll 30 and the bias roll 33 is secondarily transferred will now be described.

Figure 4:
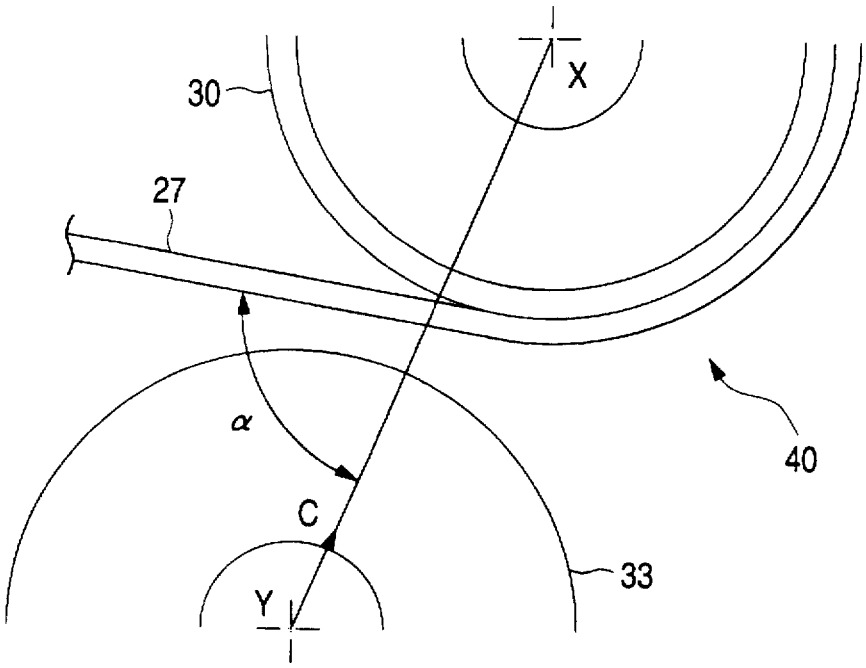
FIG. 4 shows the operation of the secondary transfer section.
Figure 5:
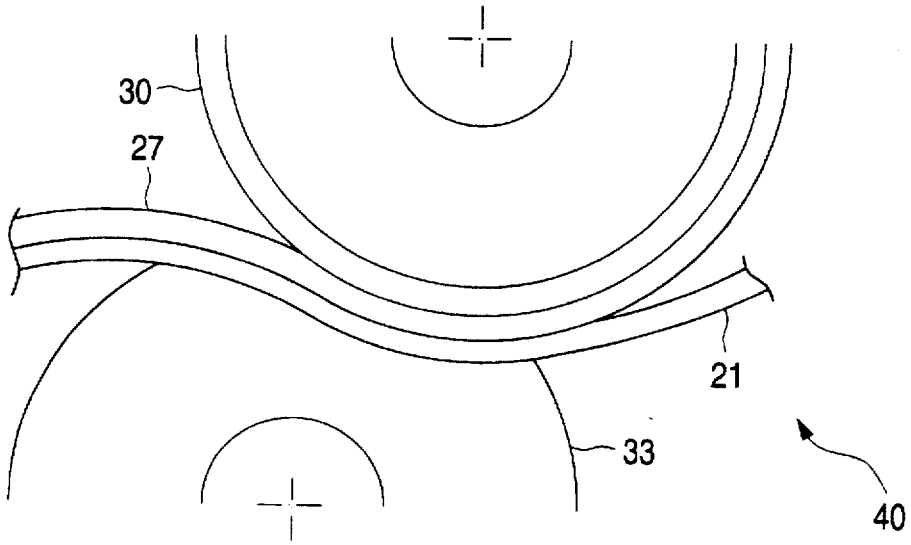
FIG. 5 shows the operation of the secondary transfer section.

As shown in FIG. 4, the bias roll 33 of the secondary transfer unit 40, which is disposed in such a manner that the angle α between the line connecting the center X of the backup roll 30 and the center Y of the bias roll 33 and the intermediate transfer belt 27 is smaller than 90°, is moved in a direction indicated by an arrow C shown in FIG. **4*f* or performing secondary transference so as to be brought into contact with the backup roll 30 through the intermediate transfer belt 27. Since the angle a between the line connecting the center of the bias roll 33 and the center of the backup roll 30 and the intermediate transfer belt 27 is smaller than 90°, the intermediate transfer belt 27 is deformed into the S-shape along both of the bias roll 33 and the backup roll 30. Therefore, the transfer paper 21 is deflected into the S-shape to fit the shape of the intermediate transfer belt 27 deflected right in front of the transfer nip to the rear end of the transfer nip (see FIG. 5**).

As a result, contact between the intermediate transfer belt 27 and the transfer paper 21 is improved right in front of the transfer region as well as in the transfer region. Therefore, forming of a gap between the intermediate transfer belt 27 and the transfer paper 21 can be prevented in the transfer region and right in front of the transfer region. As a result, reliable secondary transference can be performed.

In this embodiment, the bias roll 33 is used which has a hardness (33 degrees of ASKA C) lower than that (62 degree of ASKA C) of the backup roll 30 so that the surface of the bias roll 33 is elastically deformed when brought into contact with the intermediate transfer belt 27. Therefore, transfer characteristic of a multilayered toner for a color image or the like can, of course, be maintained. Moreover, the contact between the intermediate transfer belt 27 and the transfer paper 21 can furthermore be improved. As a result, further effective secondary transference can be performed.

Since the backup roll 30 must be operated as a follower roll for the purpose of satisfactorily moving the intermediate transfer belt 27, its hardness was set to be a required level (62 degrees of ASKA C) in the range in which it can be used as the follower roller.

As a result, even if a transfer member, such as an OHP, having a great surface resistance is used, the transfer belt and the transfer member can satisfactorily be brought into contact with each other. Since no gap is formed in the transfer region and right in front of the transfer region, a local defect in transference and retransfer can be prevented. As a result, an image free from, for example, lack of transfer, can be obtained.

Figure 6:
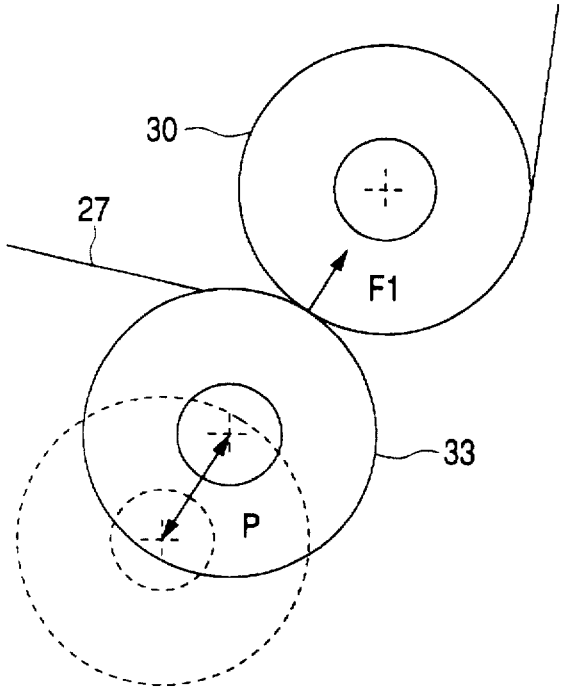
FIG. 6 shows the separation and contact operation of the bias roll according to the invention.

In this embodiment, the bias roll 33 is moved to come in contact with the intermediate transfer belt 27 and separated from the same in a direction (indicated by an arrow P shown in the drawing) along the line connecting the center of the backup roll 30 and the center of the bias roll 33, as shown in FIG. 6. Therefore, the following advantage can be realized as compared with the type shown in FIG. 7.

Figure 7:
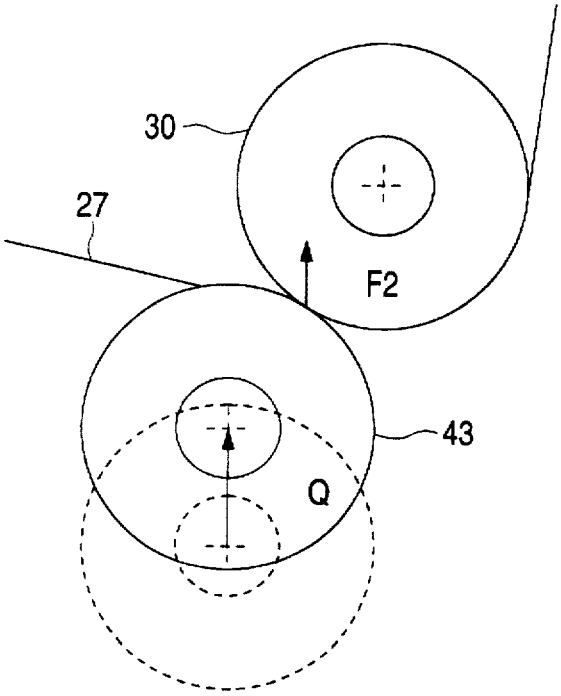
FIG. 7 shows a modification of the separation and contact operation of the bias roll according to the invention.
Figure 8:
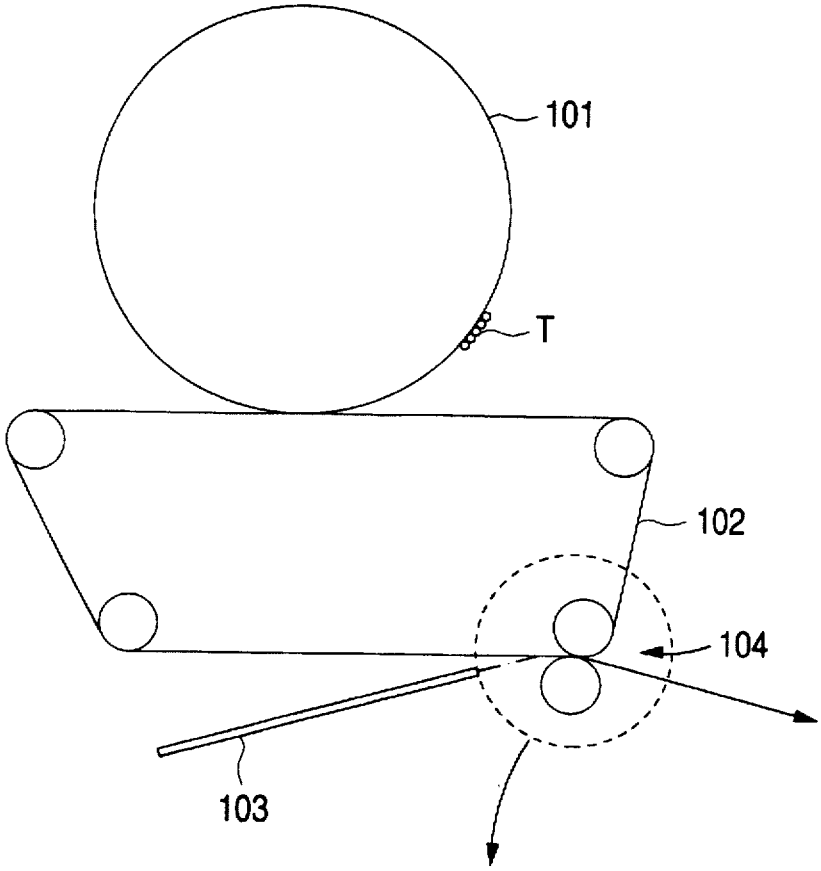
FIG. 8 PRIOR ART
FIGS. 8 and 8*a* show a conventional image forming apparatus.
Figure 8A:
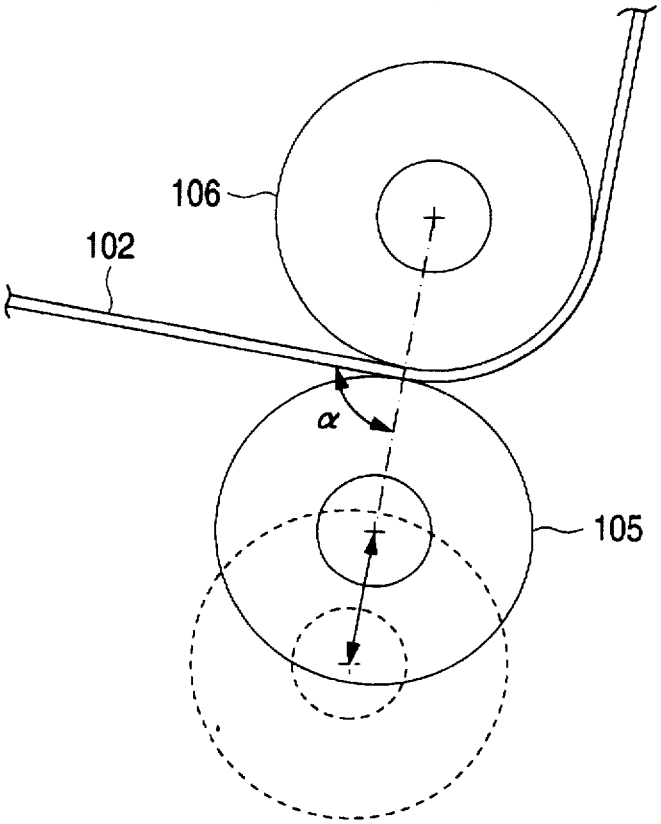
FIG. 8a PRIOR ART
Figure 9:
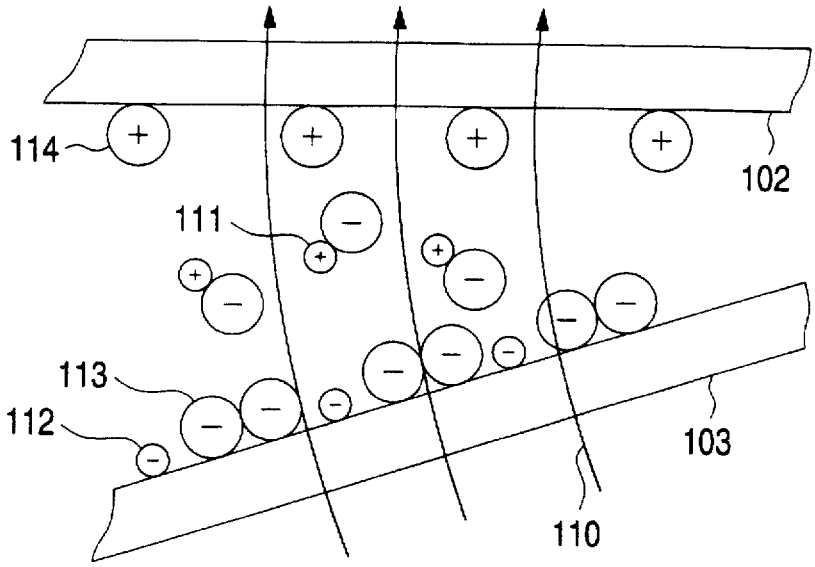
FIG. 9 PRIOR ART
FIG. 9 shows the Paschen discharge in a conventional image forming apparatus.
Figure 10:
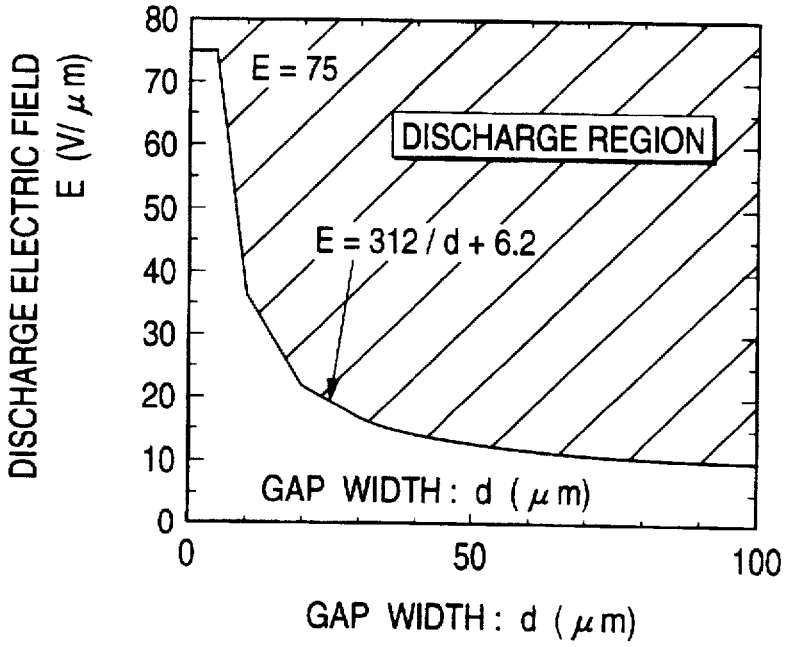
FIG. 10 is a graph showing the Paschen's law.

That is, in the structure shown in FIG. 7, the bias roll 43 is moved in a direction (indicated by an arrow Q shown in the drawing) different from the direction of the line connecting the center of the backup roll 30 and the bias roll 43 in order to perform the secondary transfer, and then is brought into contact with the intermediate transfer belt 27. Then, the bias roll 43 presses the intermediate transfer belt 27 so as to be brought into contact with the backup roll 30. At this time, since force indicated by arrow F2 acts on the intermediate transfer belt 27 and the backup roll 30, the rotation of the backup roll 30 which is being rotated attributable to the frictional force with the intermediate transfer belt is inhibited.

Although no problem arises because the foregoing force is weak in usual, the rotations of the intermediate transfer belt 27 encounters load change if the rotation is inhibited excessively. As a result, a band-like color irregularity, called "banding " takes place in the obtained image or the color registration for each color can unintentionally be shifted.

On the other hand, this embodiment has the structure as shown in FIG. 6 such that the bias roll 33 is brought into contact and separated from the intermediate transfer belt 27 along the line connecting the center of the backup roll and the center of the bias roll 33 (in a direction indicated by an arrow P shown in the drawing). Therefore, even if the force indicated by the arrow F1 acts on the intermediate transfer belt 27 and the backup roll 30, the force is able to follow the rotation operation of the intermediate transfer belt 27 and the backup roll 30. Therefore, the rotation of the intermediate transfer belt 27 does not encounter load change.

Although the structure shown in FIG. 6 is employed in a preferred embodiment of the invention, the structure shown in FIG. 7 may, of course, be employed. However, it is preferable that the magnitude of the force indicated by the arrow F2 be minimized in order to prevent the foregoing problem.

In this embodiment, the roll 43 on the outside of the intermediate transfer belt 27 is used as the bias roll and bias having a polarity reversed to that of the toner on the intermediate transfer belt 27 is applied so that the toner is transferred onto the transfer paper 21. The roll 30 on the inside of the intermediate transfer belt 27 may be employed as the bias roll and bias having a polarity which is the same as that of the toner on the intermediate transfer belt 27 may be applied to perform repulsion transference. In this case, the roll 43 must, of course, be grounded.

As described above, the transfer apparatus according to the invention has the structure such that the angle from the line connecting the center of the opposite roll disposed on the inside of the intermediate transfer belt and the center of the transfer roll and the intermediate transfer belt is made to be smaller than 90°. Therefore, the intermediate transfer belt can be deformed to fit the outer shape of both of the transfer roll and the opposite roll when the secondary transfer is performed.

As a result, the contact between the intermediate transfer belt and the transfer member can be improved right in front of the transfer region as well as in the transfer region. Since no gap is formed in the transfer region and right in front of the transfer region, the discharge phenomenon can be prevented. Since a local defect in transference and retransference can be prevented, an image can be obtained which is free from a defect, such as lack of transference.

Since the transfer apparatus according to the invention does not require any special unit to the conventional structure, the application of the invention does not enlarge the cost.

If the invention is arranged such that the transfer roll is brought into contact and separated from the intermediate transfer belt in the same direction as the line connecting the center of the transfer roll and the center of the opposite roll, the rotation of the intermediate transfer belt does not encounter the load change. Therefore, generation of band-like color irregularity called "banding " does not occur in the output image and unintentional shift of registration of each color can be prevented.

What is claimed is:

1. A transfer apparatus for an image forming apparatus for primarily transferring a toner image formed on an image holding member to an intermediate transfer belt and then secondarily transferring the toner image, which has been primarily transferred onto the intermediate transfer belt, to a transfer member, said transfer apparatus comprising:

a transfer unit for secondarily transferring the image including a transfer roll separably disposed on an outer surface of said intermediate transfer belt which holds the toner image and an opposite roll disposed to be in contact with an inner surface of said intermediate transfer belt at a position at which said opposite roll is opposite to said transfer roll, wherein, when said transfer roll has been brought into contact with said intermediate transfer belt, a central position of said transfer roll is disposed upstream with respect to a central position of said opposite roll in a direction in which said intermediate transfer belt is moved, and an angle made between a line connecting a center of said transfer roll and a center of said opposite roll to each other and said intermediate transfer belt is smaller than 90°.

2. The transfer apparatus according to claim 1, wherein, when said transfer roll has been brought into contact with said intermediate transfer belt, said intermediate transfer belt is deformed to have a shape along said transfer roll and said opposite roll.

3. The transfer apparatus according to claim 1, wherein a direction in which said transfer roll is brought into contact with and separated from said opposite roll is along the line connecting the center of said transfer roll and the center of said opposite roll to each other.

* * * * *